United States Patent [19]

Norell

[11] 4,123,380

[45] Oct. 31, 1978

[54] WASTE DISPOSAL

[75] Inventor: Karl T. Norell, Karlskoga, Sweden

[73] Assignee: AB Bofors, Bofors, Sweden

[21] Appl. No.: 784,305

[22] Filed: Apr. 4, 1977

[30] Foreign Application Priority Data

Apr. 2, 1976 [SE] Sweden ..... 7603924
Apr. 2, 1976 [SE] Sweden ..... 7603925

[51] Int. Cl.[2] ..... G21F 9/08
[52] U.S. Cl. ..... 252/301.1 W
[58] Field of Search ..... 252/301.1 W; 203/12, 203/13, 69; 159/DIG. 12

[56] References Cited

U.S. PATENT DOCUMENTS 2,324,240 7/1943 Schaafsma ..... 203/12
3,438,903 4/1969 Prahl ..... 252/478
3,716,490 2/1973 Van de Voorde ..... 252/301.1 W

FOREIGN PATENT DOCUMENTS 1,088,624 9/1960 Fed. Rep. of Germany.
1,520,681 4/1968 France ..... 252/301.1 W

*Primary Examiner*—Benjamin R. Padgett
*Assistant Examiner*—Deborah L. Kyle
*Attorney, Agent, or Firm*—Pollock, Vande Sande & Priddy

[57] ABSTRACT

Transferring solids constituents from aqueous waste containing low and/or medium radioactive solids into solid units for long-term depositing which includes adding an organic compound which forms an azeotrope with water, distilling off the azeotrope, adding a substance which is transformable into a solid state, and distilling off the organic compound.

21 Claims, 2 Drawing Figures

WASTE DISPOSAL

The present invention relates to a method of transferring the solid constituents from aqueous waste containing low and/or medium active radioactive solid constituents into solid units intended for long-time depositing.

Evaporating and drying this aqueous waste in a conventional way involves many obvious disadvantages, e.g. in the form of the risk for dust explosions. If the solid constituents consist of ion-exchange masses the disadvantages of the drying will be still greater, as the ion-exchange masses contain capillary bound water, which is difficult to remove, as such a high drying temperature is required that the ion exchange masses will be subject to undesirable decomposition, with the resulting formation of troublesome decomposition products. If granular ion-exchange masses are also included, the disadvantages will be further accentuated, as in such a case the necessary grinding will involve special difficulties. As a rule a rather complete removal of the water is extremely desirable, as for instance at an encapsulation of the waste in bitumen (which often takes place) it gives rise to considerable difficulties in the form of foaming problems, when there is only a few tenths of a percent water present.

The method of encapsulating waste in bitumen can sometimes involve certain shortcomings, e.g. in the respect that the bitumen units can melt anew at the heating, and thus constitute special risks, for instance in case of fires. According to the present invention, there are also alternative possibilities.

Through the present invention, the above-mentioned difficulties and disadvantages have been eliminated. The characteristic features of the invention will be noted from the accompanying claims.

The invention will now be described in more detail, through the following two examples of the procedure, in which reference is made to the attached FIGS. 1 and 2, which show schematic flow charts for two different devices suitable for carrying out the method according to the invention.

The aqueous waste in question in the example of the procedure which is described consists of I: An evaporation concentrate with approx. 20 percent by weight dry substance II: A suspension of granular ion exchange masses with approx. 17 percent by weight dry substance III: A suspension of powdered ion exchange masses with approx. 14 percent by weight dry substance.

Figure 1:
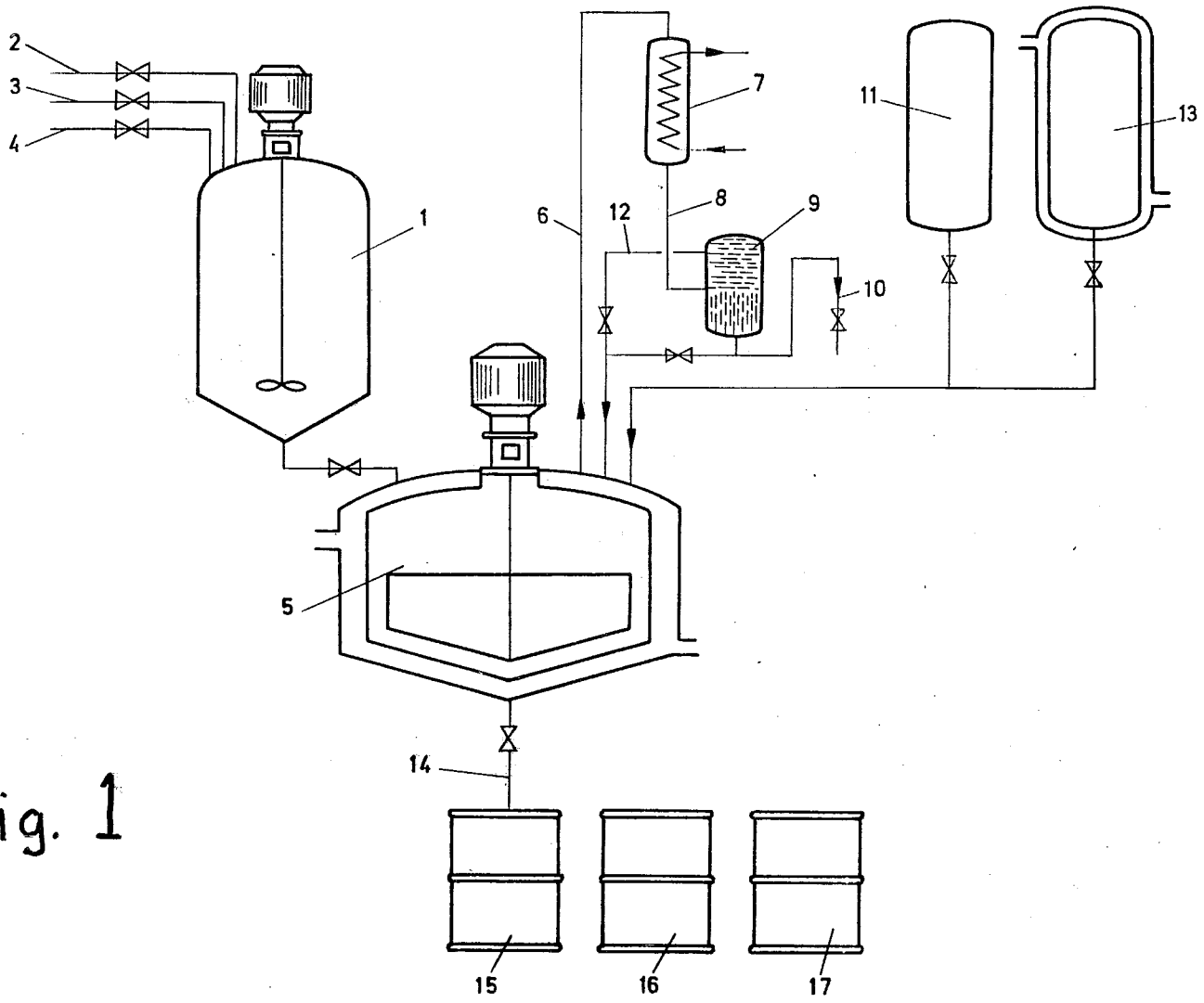

According to the procedure illustrated in FIG. 1, appropriate proportions of the above-mentioned aqueous waste are fed to a buffer tank 1 which appropriately has a capacity of approx. 2.5 $m^3$ and is provided with a propeller stirrer, via the pipes 2, 3 and 4. The quantity fed of I is approx. 200 kg, of II approx. 700 kg and of III approx. 1,000 kg, whereby the total quantity of dry substance will amount to approx. 300 kg.

The invention is, of course, also applicable to other proportions of I, II and III and can also be used for one only, or for two of these types of waste.

From the buffer tank 1, the mixture of waste is fed successively to the container 5, which can be heated, and which is provided with an effective stirrer. In conjunction therewith, the container 5 is heated so that water evaporates and the pace for the feeding from the buffer tank 1 is adapted so that the liquid volume in the container 5 is kept more or less constant. In this way, among other things, favourable heat transfer conditions are obtained. The water vapour which is removed at the evaporation is conveyed via the pipe 6 to the cooler 7, where the water vapour is condensed, and via the pipe 8, the vessel 9 and the pipe 10 the water is thereafter returned to the closed system from which the waste has come.

When the entire quantity of aqueous waste which has been put into the buffer tank 1 has been fed to the container 5, the evaporation continues until the dry substance content of the liquid present in the container 5 amounts to approx. 40 percent by weight. Thereafter, approx. 300 kg toluene is fed from the storage container 11, and through continued heating of the container 5, an azeotrope consisting of water and toluene will be conveyed off through the pipe 6, condensed in the cooler 7, and separated in the vessel 9. The heavier water will be collected in the lower part of the vessel 9, and is drained off, as described above, through the pipe 10. The lighter toluene is collected in the upper part of the vessel 9, and is returned to the container 5 via the pipe 12. The azeotropic distillation is continued until the major portion of the water has been removed from the container 5 and the water content in this container should be reduced to less than 0.5 percent by weight and preferably less than 0.2 percent by weight before the azeotropic distillation is discontinued. This can be carried out here without the temperature of the liquid in the container 5 exceeding 150° C.

When the major portion of the water has been removed from the liquid present in the container 5, in the above-mentioned way, 300 kg of melted bitumen with a temperature of approx. 110° C. is added successively from the storage vessel 13, which can be heated. At the addition of the bitumen, through the continued heating, the toluene will be distilled off through the pipe 6, condensed in the cooler 7, and via the pipe 8 will be collected in the vessel 9, from which it can be added to the next batch.

The distillation of the toluene continues until the major portion of this has been removed from the liquid present in the container 5, and the content has been reduced to less than 10 percent by weight. Thereafter the melted bitumen (which now contains the waste) is poured via the pipe 14 into three drums (15, 16, 17) each with a capacity of 200 liters, and is thereafter allowed to stiffen there. In this way, the aqueous waste has been transformed into solid units intended for long-time depositing.

Figure 2:
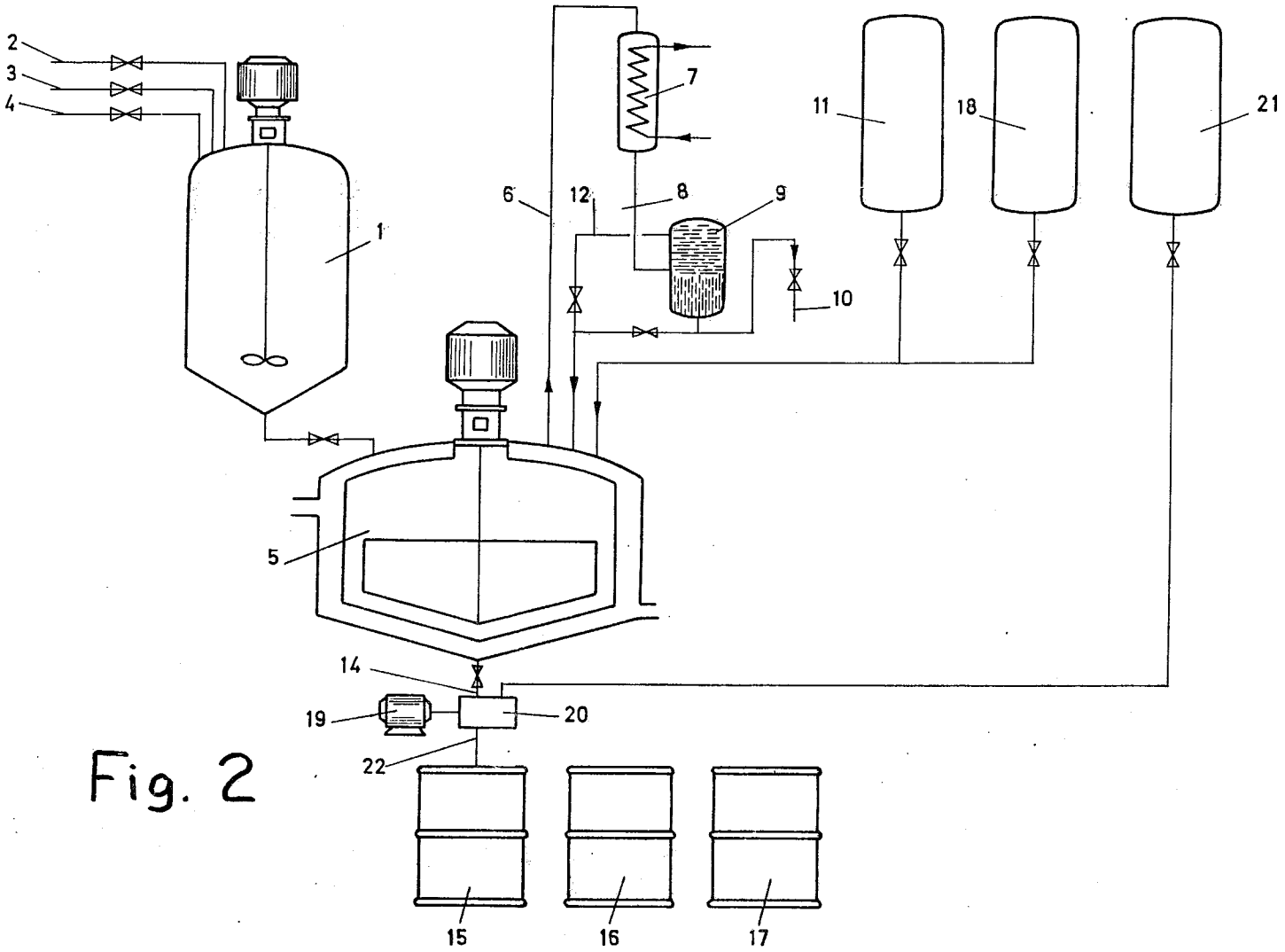

The procedure illustrated in FIG. 2 corresponds entirely to the procedure according to FIG. 1, as regards the introductory stages. Thus, the feeding of the waste via the pipes 2, 3 and 4 to the buffer tank 1, the transfer of the waste to the container 5, the heating of this and the recovery of the water vapour which is driven off is exactly the same, as well as the addition of toluene and the azeotropic distillation.

When the major portion of the water has been removed in this way from the liquid present in the container 5, instead of the melted bitumen (according to FIG. 1) approx. 230 kg polyol, e.g. with the trade mark Bermodol 79 from Berol, is added successively to the storage vessel 18 (see FIG. 2). At the addition of the polyol, the toluene will be distilled off through the pipe 6, condensed in the cooler 7, and via the pipe 8 will be collected in the vessel 9, from which it can be added to the next batch.

The distillation of the toluene continues until the major portion of this has been removed from the liquid present in the container 5, and the content has been reduced to less than 10 percent by weight. The polyol-waste mixture in the container 5 is cooled to a temperature below approx. 50° C., and is conveyed via the pipe 14 to the mechanical mixing device 20, driven by the motor 19. At the same time, 27 kg isocyanate, appropriately 4,4-diphenyl-methane diisocyanate (MDI) is conveyed to this mixing device 20 from the storage vessel 21, and through the pipe 22 the polyol-waste-isocyanate mixture is emptied into three drums (15, 16, 17) each with a capacity of 200 liters. The mixture stiftens in the drums within a few minutes, and in this way the aqueous waste has now been transferred into solid units intended for longtime depositing. As the polyurethane mass which has been formed does not melt when heated, there is a considerably greater freedom of choice of packaging for the depositing units than when the waste is encapsulated in bitumen. Further, the transition into a solid form takes place much more quickly when the present invention is applied than with bitumen encapsulation, and this of course involves certain advantages from the point of view of handling.

Further, the polyol can alternatively be added partly or entirely before and/or during the azeotropic distillation.

In order to hasten the formation of polyurethane and therewith the stiffening in the drums, an appropriate catalyst, e.g. dibutyl tin dilaurate, with the designation D 22, can be added.

Finally, the polyol-waste mixture from which the toluene has substantially been removed, can be poured directly into the vessels intended for the depositing, as in the case when the bitumen has been added, and the isocyanate can be added directly in these vessels. A stirrer should then appropriately be arranged in the depositing vessels, and this stirrer may then possibly be disconnected from its driving motor during the actual polyurethane formation, and should thereafter be allowed to remain in the depositing vessel.

The method can be varied within the scope of the accompanying claims, and it is thus possible to use organic compounds other than toluene as an entrainer at the azeotropic distillation. For instance, benzene, butyl ether, butyl chloride, cyclohexane, diisobutylene, 2,5-dimethyl furan, alkyl benzene such as ethyl benzene, ethyl butyl ether, heptane, hexyl chloride, carbon disulphide, carbon tetrachloride, tetrachloroethylene, or xylene can be used. In order to improve the flame resistance, flame retarders, e.g. in the form of phosphorus compounds, can be added.

I claim:

1. A method of transferring the solid constituents from aqueous waste containing low and/or medium active radioactive solid constituents into solid units intended for longtime depositing wherein said solid constituents contain ion-exchange masses which comprises:

(A) conveying said aqueous waste to a container provided with a stirrer;

(B) adding an organic compound which forms an azeotrope with water to said aqueous waste;

(C) distilling off said azeotrope and continuing the distilling until most or all of the water has been removed;

(D) during the distillation returning said organic compound to said aqueous waste after the water portion of said azeotrope has been removed;

(E) adding while stirring a substance which subsequently either through hardening or reaction with another substance is transformable into a solid state;

(F) distilling off most or all of said organic compound;

(G) pouring the waste from said container into a vessel for transformation into solid units for subsequent deposition.

2. A method according to claim 1, characterized in that the organic compound consists of benzene, alkyl benzene, butyl ether, cyclohexane, diisobutylene, 2,5-dimethyl furan, ethyl butyl ether, heptane, hexyl chloride, carbon disulphide, carbon tetrachloride or tetrachloroethylene.

3. A method according to claim 2, characterized in that the organic compound consists of toluene.

4. A method according to claim 1, characterized in that the azeotropic distillation is continued until less than 0.5% water remains.

5. A method according to claim 1, characterized in that the azeotropic distillation is carried out at a temperature below 150° C.

6. A method according to claim 1, characterized in that the distillation of the organic compound continues until less than 10% organic compound remains.

7. A method according to claim 1, characterized in that the distillation of the organic compound is carried out at a temperature below 150° C.

8. A method according to claim 1, characterized in that the substance added consists of melted bituman.

9. The method of claim 1 wherein said solid constituents consist substantially entirely of ion-exchange masses.

10. The method of claim 1 which includes heating said aqueous waste in said container to partially evaporate water before said organic compound is added.

11. The method of claim 10 wherein aqueous waste is continuously conveyed to the container so that during the evaporation the volume of liquid in said container is substantially constant, and after the continuous addition of aqueous waste the evaporation continues up to approximately a 40 percent dry substance content before said organic compound is added.

12. The method of claim 1 wherein the substance added includes at least one polyol and isocyanate which react together to form polyurethane

13. The method of claim 12 wherein said polyol is added continuously at the same time said organic compound is distilled off so that a substantially constant volume of liquid is obtained in said container.

14. The method of claim 12 wherein said isocyanate is 4,4'-diphenyl-methane diisocyanate.

15. The method of claim 12 wherein a catalyst for hastening the formation of polyurethane is added at about the same time as when the isocyanate is added.

16. The method of claim 15 wherein said catalyst is dibutyl tin dilaurate.

17. The method of claim 12 wherein the polyol and waste mixture is poured from said container into said vessel intended for depositing, and wherein the isocyanate is added to said vessel thereafter.

18. A method according to claim 17, characterized in that the polyol-waste mixture and the isocyanate are mixed in the depositing vessel with the aid of a stirrer, which during the formation of polyurethane is disconnected from its driving motor and is thereafter allowed to remain in the depositing vessel.

19. The method of claim 12 wherein the polyol-waste mixture and the isocyanate are mixed in a mechanical mixing device placed in a drain pipe from said container, and is thereafter poured into said vessel intended for depositing.

20. The method of claim 1 wherein a flame retarder is added.

21. The method of claim 20 wherein said flame retarder is a phosphorous compound.

* * * * *